United States Patent [19]

Giannini

[11] 4,106,461

[45] Aug. 15, 1978

[54] REFLECTIVE IGNITION TIMING PROCESS

[76] Inventor: Sebastian Louis Giannini, 1363 Teakwood Dr., San Jose, Calif. 95128

[21] Appl. No.: 661,288

[22] Filed: Feb. 25, 1976

[51] Int. Cl.[2] ..... F02P 1/00

[52] U.S. Cl. ..... 123/148 E; 324/16 T

[58] Field of Search ..... 123/148 E, 148 CB; 324/16 T; 250/338, 347

[56] References Cited

U.S. PATENT DOCUMENTS

| | | | |
|---|---|---|---|
| 3,905,347 | 9/1975 | Lapeyronnie | 123/148 E |
| 3,931,804 | 1/1976 | Bowen | 123/148 E |

*Primary Examiner*—Ronald B. Cox

[57] ABSTRACT

The subject of this disclosure is a process through which the timing function is performed for electronic ignition systems. Being specifically proposed for motorcycle use, it is a unique process intended to eliminate the shortcomings of those techniques in present use, namely those employing mechanical points and magnetic pick-ups.

4 Claims, 3 Drawing Figures

REFLECTIVE IGNITION TIMING PROCESS

SUMMARY

The timing function provides synchronism between ignition spark and piston position. This is commonly accomplished by mechanically sensing the angular position of the crankshaft either directly or through a gear or chain driven camshaft. A more recent method employs contactless, magnetic sensing.

The first method, the cam/point design, uses a switch that consists of two electrical contact points. One contact point is stationary while the other is on a movable, spring-loaded arm that is mechanically actuated by a revolving cam. Though simple in design, this method suffers major drawbacks. Among the most serious is the eventual timing error caused by wear of the cam rubbing block and contact erosion. In order to insure consistent performance and acceptable pollution levels, frequent and costly tune-ups are needed. Furthermore, at high speeds, ignition performance is degraded because of point bounce and point float. These are characteristics inherent to a mechanical timing design.

The second method employs a magnetic sensing device. Its operation depends on a changing magnetic reluctance. It consists of a pole piece (stator) and a rotor. The rotor is slotted, thereby varying the distance and hence the reluctance between it and the stator during rotation. A change in reluctance causes a change in magnetic flux across a pick-up coil that is wound on the stator, thereby inducing a voltage signal. However, it too has disadvantages. The signal level from a magnetic transducer is a function of engine speed. It must generate usable signals at engine speeds as low as that encountered during cranking. The air gap between the rotor and stator must be small, typically 0.010 inches, to achieve required performance economically. Close tolerances must be maintained to guarantee reliable performance. The signal conditioning associated with a magnetic sensing device must provide accurate triggering over a wide range of input signal levels. In addition, it must provide sufficient noise immunity to prevent false triggering yet sufficient amplification to process very low level input signals. This technique is costly to implement and space consuming.

The process proposed herein uses a reflective optical coupler in conjunction with extremely simple signal processing and alignment circuits. Its individual components are widely used; but when placed together form a unique way of performing the ignition timing function. Its development, construction and testing were motivated by the inavailability of a truly cost conscious, high performance, virtually maintenance free timing system. Its underlying basis is simplicity, one that eliminates the shortcomings of the methods described in the foregoing discussion.

Optical ignition systems are available for automotive applications. However, their timing function is achieved by a slotted disc that interrupts optical coupling during cam rotation. The spatial requirements of this technique make it prohibitive for motorcycle use since their ignition housing is often restricted to a very small area. In addition, the internal circuitry of such systems frequently lack signal conditioning necessary for fast switching speeds.

GENERAL DESCRIPTION

The reflective optical coupler is the heart of this process. It consists of a light emitting diode (LED) as a light source and a phototransistor as a detector. The source and detector are geometrically arranged so that a reflective surface is needed to achieve optical coupling. Coupling can be interrupted by changing the distance to the reflective surface or changing the reflective properties of the surface. Since most motorcycle ignition systems seldom employ a vacuum spark advance mechanism, a stationary breaker plate is used in their ignition housing and a constant coupler-to-surface distance can be maintained. Thus, the optical characteristics of the reflective coupler make it ideal for sensing a camshaft's angular position. The timing function is achieved by applying strips of light absorbent material to the polished periphery of a cylindrical sleeve that fits over the timing cam. As the camshaft rotates, optical coupling is interrupted, whereby the detector changes conduction state and a voltage signal is produced.

The output of the optical transducer is processed whereby it is transformed from an approximate square wave to a more ideal one. As shown in FIGS. 1 and 2 this design is suitable for timing electronically switched inductive (ESI) and capacitive discharge ignition (CDI) systems, respectively. Note that the square wave polarity is reversed for the two systems. The ESI ignition system induces a spark when switched off. Thus, a negative going pulse is needed to reverse bias the transistor switching network that is in series with the ignition coil. The CDI system on the other hand, induces a spark during conduction whereby energy stored in a capacitor is transferred to the ignition coil. Thus a positive going pulse is needed to forward bias the electronic switching network that closes the discharge path. A silicon controlled rectifier (SCR) normally provides such switching.

A switch applies the couplers output to the alignment circuit for static adjustments. This is used for initial coupler alignment and static timing adjustment. No special tools or test equipment are needed.

DETAILED DESCRIPTION

Figure 1:
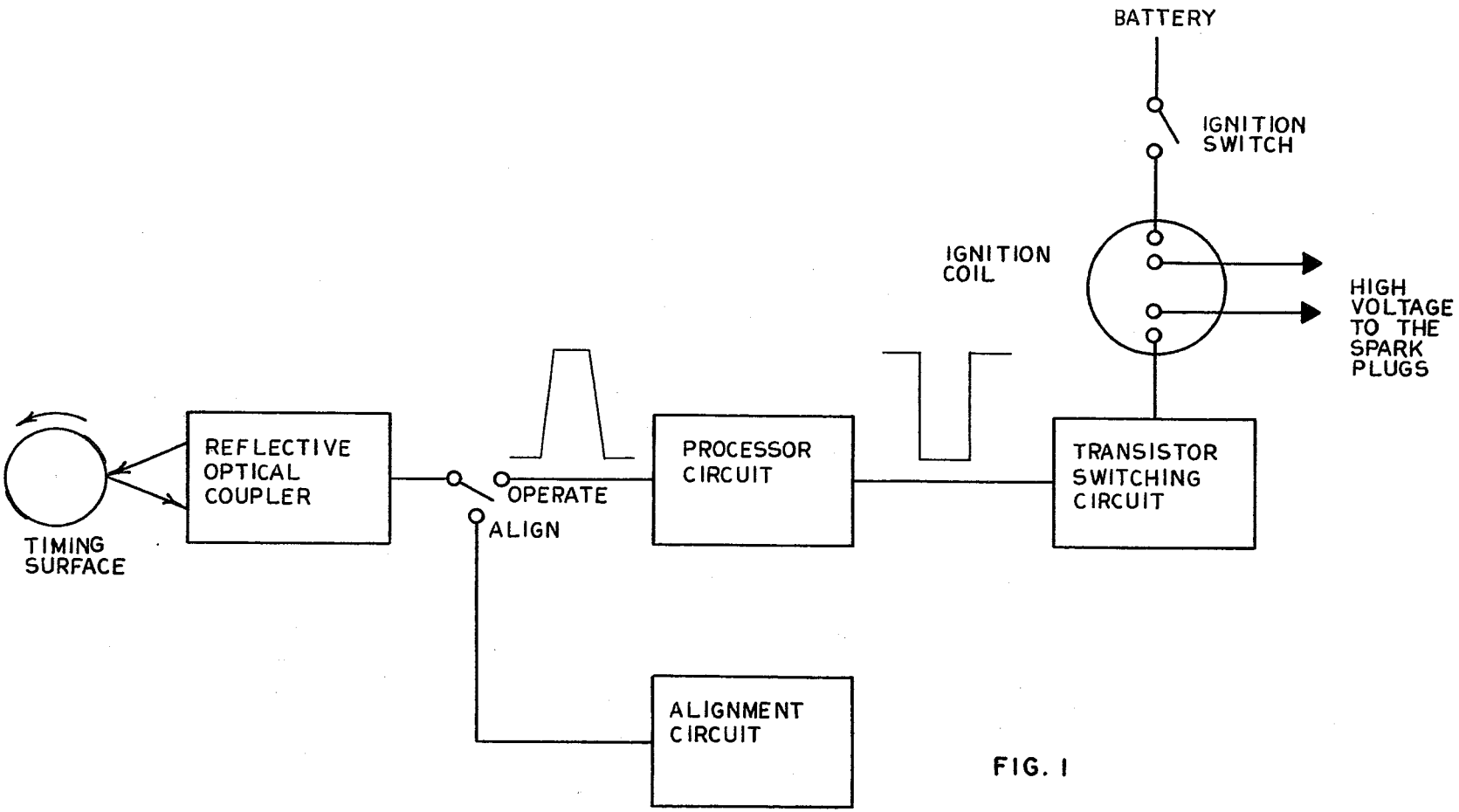
FIG. 1 shows the basic optical system applied to an inductive interruption ignition.
Figure 2:
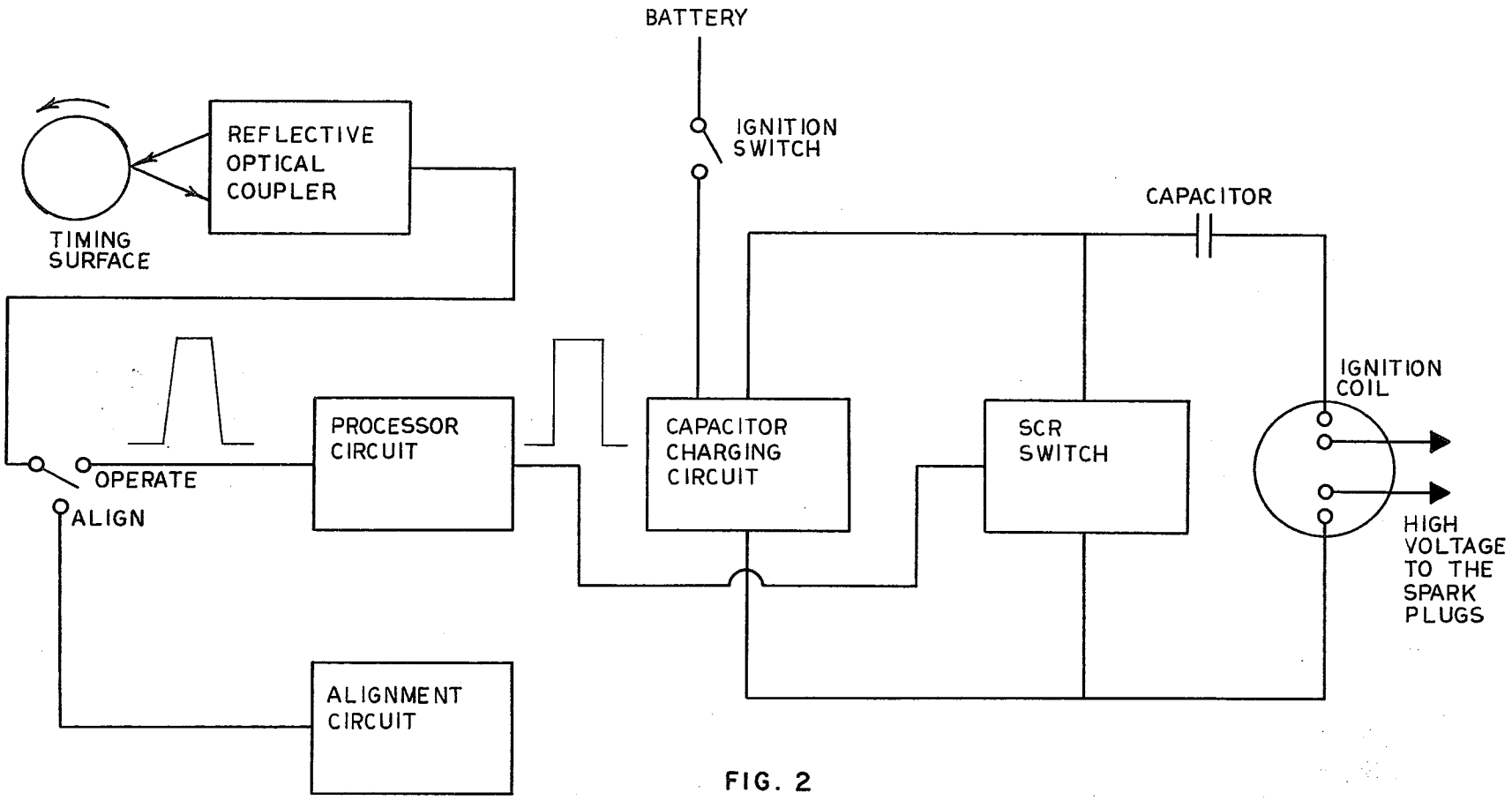
FIG. 2 shows the basic optical system applied to a capacitive discharge ignition.
Figure 3:
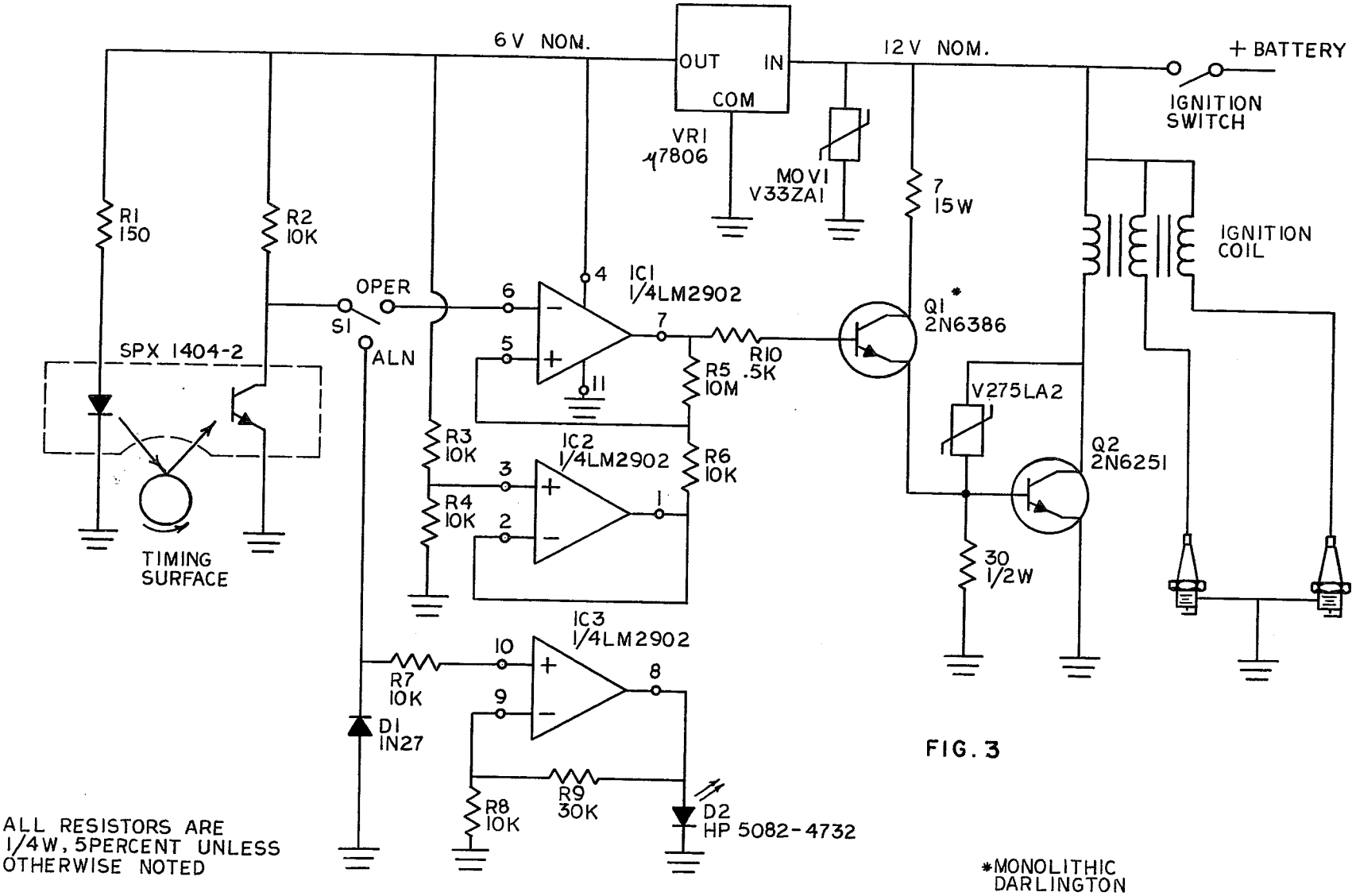
FIG. 3 shows a specific schematic circuit of FIG. 1.

When placed together, the reflective coupler, processor and alignment circuits form an extremely simple electronic ignition timing network. The schematic diagram of FIG. 3 shows how these elements are functionally related to perform the timing function for an ESI ignition system. This design is in present use on a 1973 CL175 Honda motorcycle. A dual coil version of the above design is near completion. Though suitable for CDI triggering, the ignition circuit of FIG. 3 was used instead. Because of the extremely fast transistor switching speeds achieved with the above system, CDI was not considered warranted.

The metallic sleeve that is used as a reflector is secured in place by an existing fastener that holds the centrifugal advance mechanism to the engines camshaft (this is virtually universal). It is very small with an inside diameter of $\frac{5}{8}$ inch, a height of 5/16 inch and a thickness of 1/16 inch. The light absorbent strips on its periphery are positioned to satisfy the engine's timing requirements. They consist of Furane 8018 Primer, a very rugged material, that is impervious to the engine's harsh environment. It can be applied by spraying, brushing or dipping.

Base current necessary for phototransistor conduction is induced by light radiation from the LED, reflected off the camshaft sleeve. The LED current is applied through the dropping resistor R1. The phototransistor is used in a common emitter configuration with R2 insuring saturation during conduction, witn an output collector voltage of 0.5 volts. As the camshaft rotates, its light absorbing surface interrupts optical coupling thereby turning off the phototransistor, resulting in an output voltage of 5.5 volts. The ON and OFF states are dictated by the widths of the reflective and non-reflective surfaces respectively.

With S1 in the "ALIGN" position, the coupler's output is applied to the noninverting input of 1C3. It is amplified and applied to the voltage sensing LED, D2. When correctly aligned with the reflective surface, the couplers output voltage decreases whereby its amplified value is insufficient to illuminate D2. However any increase of the coupler's output voltage because of excessive misalignment will cause D2 to turn on. The closed loop gain of IC3 (4) provides design margin whereby small errors in alignment or varying reflective surface fineness will not cause inadvertent illumination of D2. In addition to initial coupler alignment, this circuit provides indication of beam interruption whereby static timing adjustment can be performed. D1 insures LED turnoff when S1 is in the "OPERATE" position.

With S1 in the "OPERATE" position, the coupler's output is applied to the inverting input of IC1. IC1 in conjunction with R5 and R6 forms a regenerative comparator or Schmitt trigger. Its voltage reference is provided by the voltage divider network R3 and R4 through the voltage follower 102. The comparator has two possible output levels, −0.5 volts and 4.5 volts. During its ON state the couplers output level is low. Being less than the reference voltage, 3 volts, the comparator maintains an output of 4.5 volts. This causes saturation of Q1 and Q2 and hence conduction through the ignition coil. R10 insures sufficient base current to saturate Q1 and hence Q2, yet prevents overloading of IC1. As the camshaft rotates, its light absorbing surface interrupts optical coupling, resulting in a high transducer output. This is sufficient to switch the comparator output to −0.5 volts, reverse biasing Q1 and driving Q2 to cutoff. Thus current through the ignition coil is abruptly interrupted, inducing a high voltage in its secondary windings for application to the spark plugs. During normal operating conditions the coupler's output signal has a rise and fall time that is dictated by the coupler's beam width in conjunction with the speed of the interrupting surface. Though the beam width is very narrow, the comparator insures consistently fast switching, typically less than 10 microseconds, that is independent of engine speed. Quick transition between output levels is needed for fast coil switching speeds. This insures an extremely fast rising voltage to the spark plug and rapid coil recovery to the conduction state. For CD1 application the coupler output is applied to the non-inverting input of IC1 and the feedback is applied to the inverting input. This results in a comparator output that is in phase with its input.

Power to all components in the timing network of FIG. 3 is supplied through the voltage regulator VR1. This insures relatively constant operating voltage over a wide range of input voltages, thereby providing consistent performance and long life. The metal oxide varistor MOV1, shunts the regulator input to guard against any possible harmful voltage transients.

I claim:

1. An ignition system for internal combustion engines comprising a light source and photodetector, a shutter rotated at a speed proportional to engine speed to alternately interrupt and pass light from said light source to said photodetector, an indicator actuated by said photodetector to preoperationally align light from said light source to said photodetector, a pulse shaper actuated by said photodetector to provide rapid signal transition between voltage levels resulting from passage and interruption of light from said light source to said photodetector, a pulse amplifier actuated by said pulse shaper to provide switching of current through the ignition coil, said lightsource being a light emitting diode and said photodetector being a phototransistor each integrally mounted and geometrically related whereby light from said light source to said phototransistor has a predetermined focal distance from the said interrupter, said interrupter consisting of a cylindrical sleeve with alternate reflective and light absorbing areas corresponding to the timing requirements of the engine, said pulse shaper being a regenerative comparator with switchable inputs to produce outputs in phase or opposite in phase to input to drive an electronically switched inductive ignition output stage or capacitive discharge ignition output stage to the ignition coil.

2. An ignition system as in claim 1 wherein said indicator is a voltage sensing light emitting diode preceded by a driver amplifier that senses the amount of light from said source to said pickup by detecting said pickup output voltage during the reflective mode of operation.

3. An ignition sytem as in claim 1 wherein said interrupter is the standard breaker cam lobe and said pulse shaper is a regenerative comparator with a voltage reference that is proportional to the pulse width from said photodetectors causing a shift in the triggering point on the cam as a function of engine speed and hence providing an electronic advancing function.

4. An ignition system as in claim 1 wherein said pulse amplifier is a power switching transistor preceded by a power switching Darlington amplifier that transforms the current output capability of said pulse shaper to one capable of driving said switching transistor and hence the ignition coil.

* * * * *